US005437069A

United States Patent [19]

Bates

[11] Patent Number: 5,437,069

[45] Date of Patent: Aug. 1, 1995

[54] PORTABLE FOLDING PILLOW PROP APPARATUS

[76] Inventor: Norman H. Bates, 1182 Hyde Park, Santa Ana, Calif. 92705

[21] Appl. No.: 206,662

[22] Filed: Mar. 7, 1994

[51] Int. Cl.[6] ..... A47C 21/00

[52] U.S. Cl. ..... 5/633

[58] Field of Search ..... 5/633, 634, 635, 632, 5/630

[56] References Cited

U.S. PATENT DOCUMENTS

| | | | |
|---|---|---|---|
| 200,504 | 2/1878 | Buell | 5/633 |
| 635,578 | 10/1899 | Nixon | 5/634 |
| 2,545,311 | 3/1951 | Rosberger . | |
| 3,041,637 | 7/1962 | Emery | 5/634 |
| 3,121,884 | 2/1964 | Emery | 5/634 |
| 3,329,979 | 7/1967 | Drapin | 5/634 |
| 3,808,616 | 5/1974 | White | 297/377 |
| 4,242,767 | 1/1981 | McMullen et al. | 5/465 |
| 4,635,306 | 1/1987 | Willey | 5/465 |
| 4,777,678 | 10/1988 | Moore | 5/465 |
| 4,970,742 | 11/1990 | Keener | 5/465 |
| 4,987,625 | 1/1991 | Edelson | 5/420 |
| 5,193,238 | 3/1993 | Clute | 5/655 |

FOREIGN PATENT DOCUMENTS

| | | |
|---|---|---|
| 949771 | 9/1956 | Germany . |
| 2180150 | 3/1987 | United Kingdom . |

*Primary Examiner*—Alexander Grosz
*Attorney, Agent, or Firm*—Thomas I. Rozsa; Tony D. Chen

[57] ABSTRACT

The present invention is a pillow prop apparatus which is portable. The pillow prop apparatus is used for supporting a person's back while sitting or sleeping at an angle. The pillow prop apparatus forms a 90° right angle triangle which has a 30° angle at one location and a 60° angle at the other location. There are a multiplicity of shaped openings on all surfaces of the pillow prop for preventing the pillow prop from sliding on the bed or on a surface on which it is placed.

29 Claims, 5 Drawing Sheets

PORTABLE FOLDING PILLOW PROP APPARATUS

BACKGROUND OF THE INVENTION

1. Field of The Invention

The present invention relates to the field of support pillows. In particular, the present invention relates to devices for providing back and head support.

2. Description of The Prior Art

Specifically, when someone watches TV in bed, the person usually uses several pillows to raise his or her head upwards and to support his or her back. There are many devices in the consumer market to prop the person's back while watching TV or sleeping. In the prior art, one of the devices is an adjustable mechanical bed which raises the front of the bed at an angle so that a person can sleep or watch TV comfortably. Another device is an oversize inflatable cushion. One of the many disadvantages with these types of devices is that they are not portable or foldable. Another disadvantage is that adjustable mechanical beds are very expensive to manufacture and the cost is passed on to the consumer. A further disadvantage is that the oversized inflatable cushion can slide on the surface on which it is placed, and this makes it difficult for a person to rest his or her back on the inflatable cushion.

The following ten (10) prior art patents were uncovered in the pertinent field of the present invention.

1. U.S. Pat. No. 2,545,311 issued to Rosberger on Mar. 13, 1951 for "Sectional Mattress Holder" (hereafter "the Rosberger Patent").

2. U.S. Pat. No. 3,808,616 issued to White on May 7, 1974 for "Free Form Cushion Assembly" (hereafter "the White Patent").

3. U.S. Pat. No. 4,242,767 issued to McMullen et al. on Jan. 6, 1981 for "Play Pillows" (hereafter "the McMullen Patent").

4. U.S. Pat. No. 4,635,306 issued to Willey on Jan. 13, 1987 for "Multi-Position Therapy Cushions" (hereafter "the Willey Patent").

5. U.S. Pat. No. 4,777,678 issued to Moore on Oct. 18, 1988 for "Method And Apparatus For Providing Back Support" (hereafter "the Moore Patent").

6. U.S. Pat. No. 4,970,742 issued to Keener on Nov. 20, 1990 for "Multi-Sectional Back Rest And Pillow Having The Capability Of Assuming A Series Of Different Configurations" (hereafter "the Keener Patent").

7. U.S. Pat. No. 4,987,625 issued to Edelson on Jan. 29, 1991 for "Adjustable Personal Support Apparatus" (hereafter "the Edelson Patent").

8. U.S. Pat. No. 5,193,238 issued to Clute on Mar. 16, 1993 for "Infant Support Pillow" (hereafter "the Clute Patent").

9. British Patent No. 2,180,150 issued to Wakeham et al. on Mar. 25, 1987 for "Recliner" (hereafter "the Wakeham Patent").

10. German Patent No. 949,771 (hereafter "the German Patent").

The McMullen Patent discloses a play pillow construction. It includes a multiplicity of square shaped pillows and equilateral triangular shaped pillows joined to form a three dimensional triangular shape. Each pillow is releasably secured together by snap fasteners to form the polyhedral triangular shaped depicted. A cushioning material is shaped in the triangular form of the pillow, and is covered by an upper layer and a lower layer of fabric.

The Willey Patent discloses multi-position therapy cushions. It includes therapy cushions which provide angular body supporting surfaces.

The Moore Patent discloses a method and apparatus for providing back support. It includes four resilient pillows made from medium-density foam.

The Keener Patent discloses a multi-sectional back rest and pillow. It is capable of assuming a series of different configurations. The pillow itself is converted from a back rest configuration to a pillow configuration, wherein the multi-sectional pillow can be appropriately supported and used on a conventional bed in either configuration.

The Clute Patent discloses an infant support pillow. It includes two adjustably affixed main sections which are detachable from one another. Each section includes two elongated triangular resilient foam members which form right triangles.

The Wakeham Patent discloses a recliner. It includes a pair of U-shaped frame members which are pivotally connected by straps at the bases of the U-shaped frames so as to be pivotable between an open and a closed position. Uprights of the two U-shaped frames define legs on which the frame can be rested on the ground.

The Rosberger Patent discloses a sectional mattress holder. It includes an elongated rectangular flexible top wall sheet which is equal to the length of a sectional mattress.

The White Patent discloses a free form cushion assembly. It includes an interior cushion segment and two flank cushion segments. Either one of the flank cushion segments is adapted to be buttressed by brace members in an inclined position to form a head or back rest when the device is used as a lounge.

The Edelson Patent discloses an adjustable personal support apparatus. It includes a multiplicity of resilient cushions which are flexibly attached in a collapsible unitary structure and can be easily adjusted to provide head and body support for persons working or resting in prone, supine and other bodily attitudes.

The German Patent, as disclosed by the figures shows a support apparatus with hinged sections.

The concept of providing back and head support have been previously been disclosed by various cited prior art patents. However, none of these patents has taught a portable three-panel structure which when folded is of the shape and size of a briefcase.

Therefore, there is always a need to provide improved devices for comfortably providing back and head support while sitting or sleeping at an angle. It is desirable to design a pillow prop which is portable, foldable and does not slide on the surface on which it is placed. The pillow prop will provide two positions on which the person can rest comfortably.

SUMMARY OF THE INVENTION

The present invention is a portable folding pillow prop apparatus which provides a three-panel structure. The present invention can be made of styrene material or stiff plastic material.

The present invention is to use the portable folding pillow prop apparatus for supporting a person's back while sitting or sleeping at an angle. When the portable folding pillow prop apparatus is assembled, the pillow prop forms a 90° right angle triangle which can be seen from the side of the pillow prop. The pillow prop has a 30° angle at one location and a 60° angle at the other location.

There are a multiplicity of shaped openings which are provided on all surfaces of the portable folding pillow prop apparatus for preventing the pillow prop from sliding on the bed or on a surface on which it is placed. The openings reduce the manufacturing costs and the cycle time for the styrene material or plastic material to cool. The openings also offer an attractive design and prevent a soft pillow placed on the pillow prop from sliding on the surface. The portable folding pillow prop apparatus can be utilized in two positions in which the person can rest at either a 30° or a 60° inclined position.

The advantage of using the present invention is that it can assist a person sleeping at an angle on a conventional flat bed. It can also assist people who have problems in breathing when they are sleeping on conventional flat beds.

Another use for the portable folding pillow prop apparatus is that a pregnant woman must sleep at an angle and the portable pillow prop assists the woman sleeping on a conventional flat bed.

It has been discovered, according to the present invention, that by designing and manufacturing a pillow prop apparatus which is portable, it will provide a way for a user to carry the pillow prop apparatus with them. The pillow prop apparatus can also be placed in luggage and taken on trips.

It has further been discovered, according to the present invention, that by utilizing a pillow prop apparatus with a multiplicity of shaped openings on all surfaces of the pillow prop, the pillow prop apparatus will not slide on the surface on which it is placed, and further offer an attractive design. In addition, a soft pillow placed on the surface of the pillow prop apparatus is prevented from sliding on the pillow prop apparatus.

It is therefore an object of the present invention to provide a pillow prop apparatus which is portable, so that a user can easily carry the pillow prop apparatus around like a briefcase or place it in luggage.

It is also an object of the present invention to provide a pillow prop apparatus with a multiplicity of shaped openings on all surfaces of the pillow prop apparatus, so that a pillow or other fluffy member does not slide on the surface of the pillow prop apparatus and further, so that the pillow prop apparatus itself cannot slide on the bed sheet or other surface on which it is placed.

It is an additional object of the present invention to provide a pillow prop apparatus which includes two positions in which the person can rest at either a 30° inclined position or a 60° inclined position, so that it can assist the person to sleep at a desired angle on a conventional flat bed.

It is a further object of the present invention to provide a pillow prop apparatus which will conform to conventional forms of manufacture, be of simple construction and easy to use so as to provide a device that will be economically feasible, long lasting and relatively trouble-free in operation.

In the preferred embodiment of the present invention, the pillow prop apparatus consists of a three-panel structure which includes a front panel, a rear panel and a base panel, where both the front and the base panels are hingeably attached to the rear panel.

In general, the uniqueness of the present invention pillow prop apparatus is that it is a portable three-panel structure. When folded, it is of the shape and size of a briefcase and can be easily carried around.

It will be appreciated that the present invention pillow prop apparatus is not limited to the above advantages, but it can be utilized in many other situations not described above.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
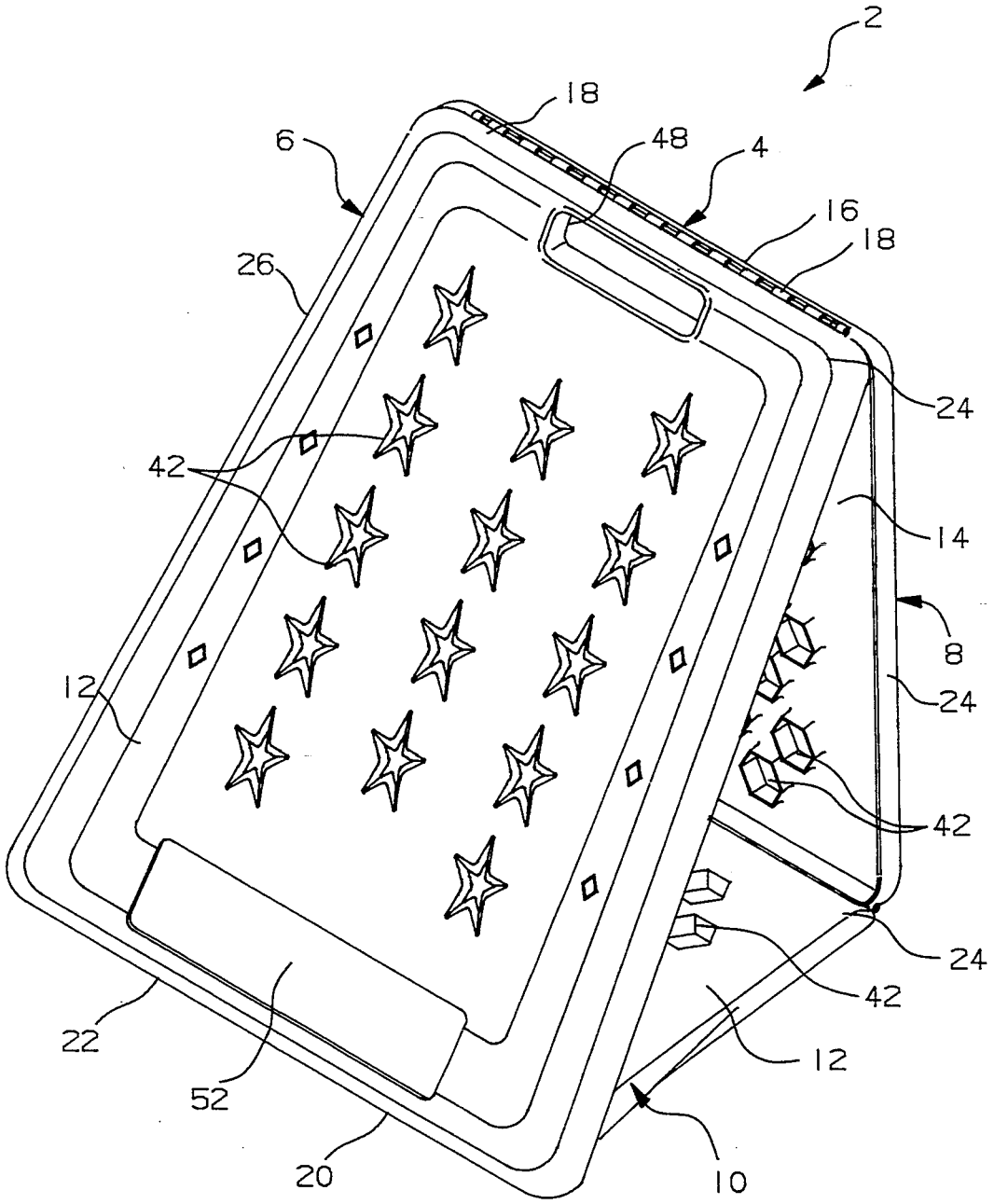
FIG. 1 is a perspective view of the preferred embodiment of the present invention portable folding pillow prop apparatus in its unfolded or open condition.

Referring to FIG. 1, there is shown a perspective view of the present invention pillow prop apparatus 2 in its open or unfolded condition. The pillow prop apparatus 2 has a generally elongated foldable body or member 4 which includes a front panel 6, a rear panel 8, and a base panel 10. Each panel has an upper side or surface 12, a lower side or surface 14, a top end 16 with a transverse top wall 18, a bottom end 20 with a transverse bottom wall 22, and a pair of longitudinal and opposite exterior sidewalls 24 and 26. The front and rear panels 6 and 8 are generally rectangular in shape in which the top ends 16 are tapered such that the bottom ends 20 are wider than the top ends 16. The lower side 14 of each panel is surrounded by the walls 18, 22, 24, and 26. A rectangular shaped detent recess 52 is provided on the upper side 12 of the front panel 6 and located adjacent to the bottom end 20 to provide an area for printing and silkscreening such that decals, words, symbols and other decorations can be placed on the pillow prop apparatus 2.

The rear panel 8 has a length less than the length of the front panel 6 but greater than the length of the base panel 10. By way of example, the overall lengths, widths and depths of the front panel 6, the rear panel 8 and the base panel 10 are approximately 21.00 inches by 17.25 inches by 0.80 inch, 17.50 inches by 17.00 inches by 0.70 inch, and 11.00 by 14.50 inches by 0.60 inch respectively. It will be appreciated that these dimensions described above are merely one illustrative embodiment and can include many other comparable sets of dimensions.

Figure 2:
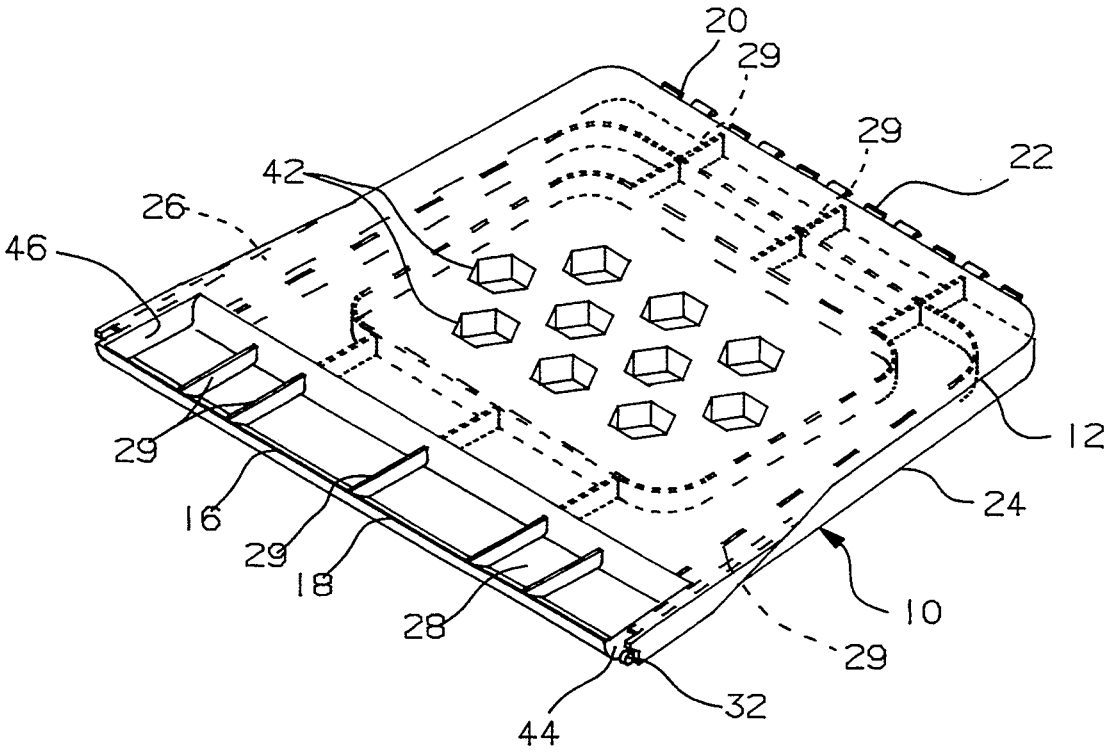
FIG. 2 is a perspective view of the base panel of portable folding pillow prop apparatus showing the transverse step-down section.

Referring to FIG. 2, there is shown a perspective view of the base panel 10 which has a transverse step-down section 28 located adjacent to the top end 16, where the transverse top wall 18 is curved inwardly towards the upper side 12. Two opposite tabs or fasteners 32 (only one is illustrated) are located adjacent to the top end 16 of the base panel 10 and are respectively protruding outwardly from two opposite interior sidewalls 44 and 46. These interior sidewalls 44 and 46 are adjacent to and parallel to the pair of longitudinal and opposite exterior sidewalls 24 and 26 of the base panel 10 respectively. The base panel 10 also includes a multiplicity of longitudinal ribs 29 which are shown in solid lines and dashed lines for supporting and strengthening the base panel 10. These longitudinal ribs 29 are located on the upper and lower sides 12 and 14 of the base panel 10, where the longitudinal ribs 29 also stabilizes and strengthens the transverse step-down section 28 of the base panel 10.

Figure 7:
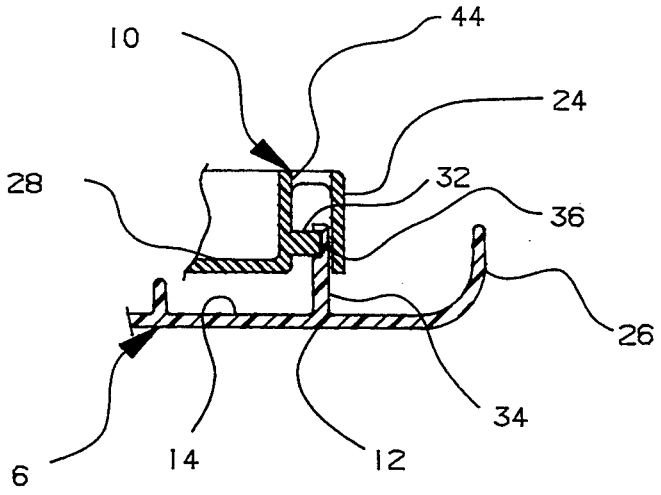
FIG. 7 is an enlarged partial cross-sectional view of the front and the base panels which illustrate the sliding mechanism.
Figure 3:
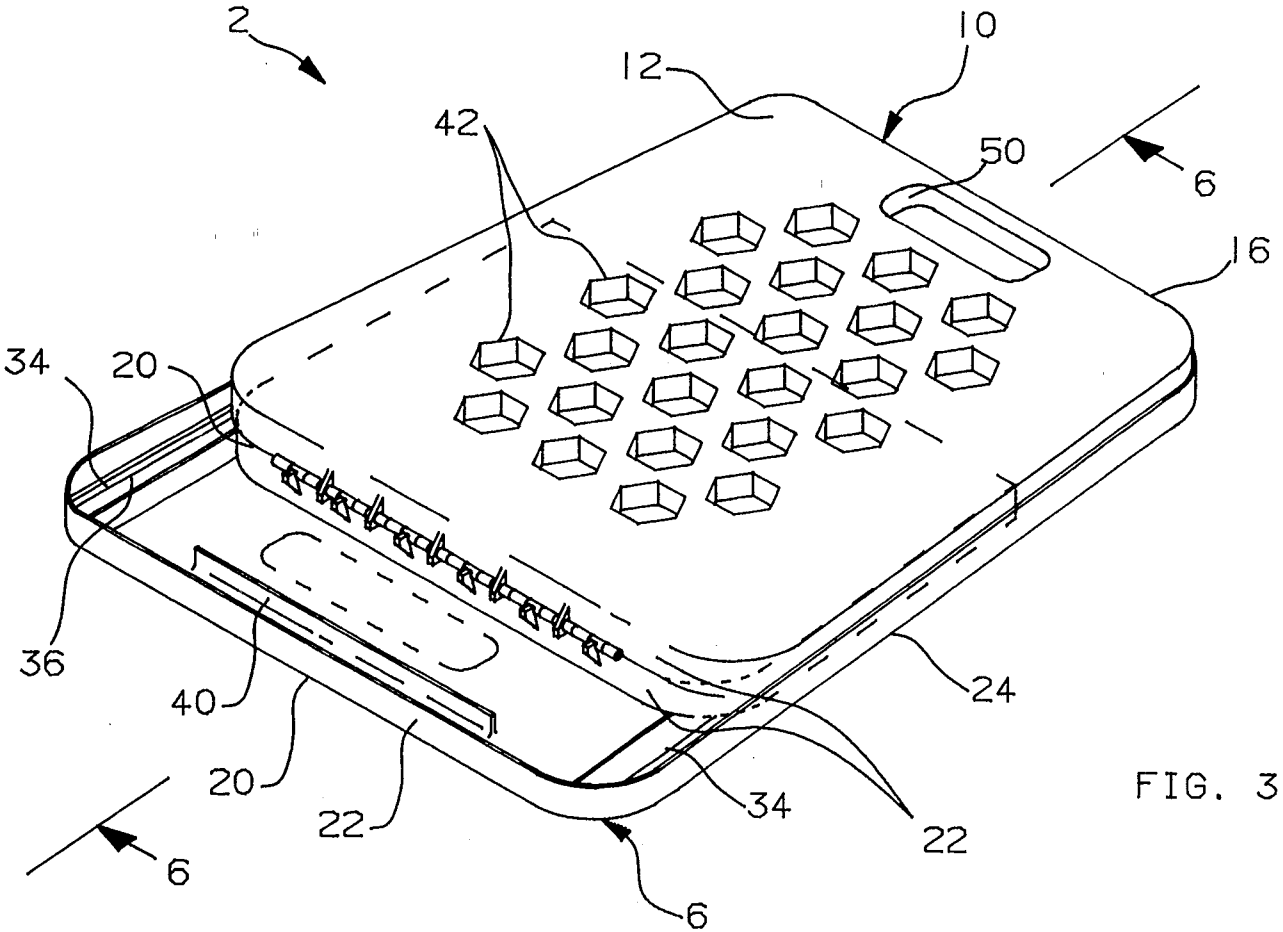
FIG. 3 is a perspective view of the present invention portable folding pillow prop apparatus in its folded or closed condition.

FIG. 3 shows a perspective view of the present invention pillow prop apparatus 2 in its closed or folded condition. Referring to FIGS. 1, 3 and 7, the front panel 6 further has two longitudinal parallel and opposite interior sidewalls 34 which are located on the lower side 14 adjacent to the pair of longitudinal and opposite exterior sidewalls 24 and 26 respectively. Each longitudinal interior sidewall 34 has a longitudinal guide rail 36 (only one is illustrated in FIG. 3) which engages with a respective one of the two opposite tabs 32, as shown in FIG. 7, for allowing the base panel 10 to slide back and forth from the folded condition to the unfolded condition within the front panel 6. FIG. 7 shows a detailed sliding mechanism of the pillow prop apparatus 2. The pair of exterior sidewalls 24 and 26 of the base panel 10 are utilized for stabilizing the sliding of the base panel 10. Each of the longitudinal interior sidewalls 34 of the front panel 6 are respectively sandwiched between the interior sidewalls 44 and 46, and the pair of exterior sidewalls 24 and 26 of the base panel 10 respectively. It will be appreciated that this is only one illustration of the sliding mechanism and can include many other different types of sliding mechanisms which can be incorporated with the pillow prop apparatus 2.

Referring to FIGS. 1 and 3, the front and rear panels 6 and 8 are each provided with a generally rectangular shaped opening, 48 and 50 respectively, which are located adjacent to the top ends 16. These openings 48 and 50 are utilized for carrying the pillow prop apparatus 2 around like a briefcase such that when the two openings 48 and 50 are aligned with each other, the pillow prop apparatus 2 is in its folded or closed condition and can be carried around.

Figure 4:
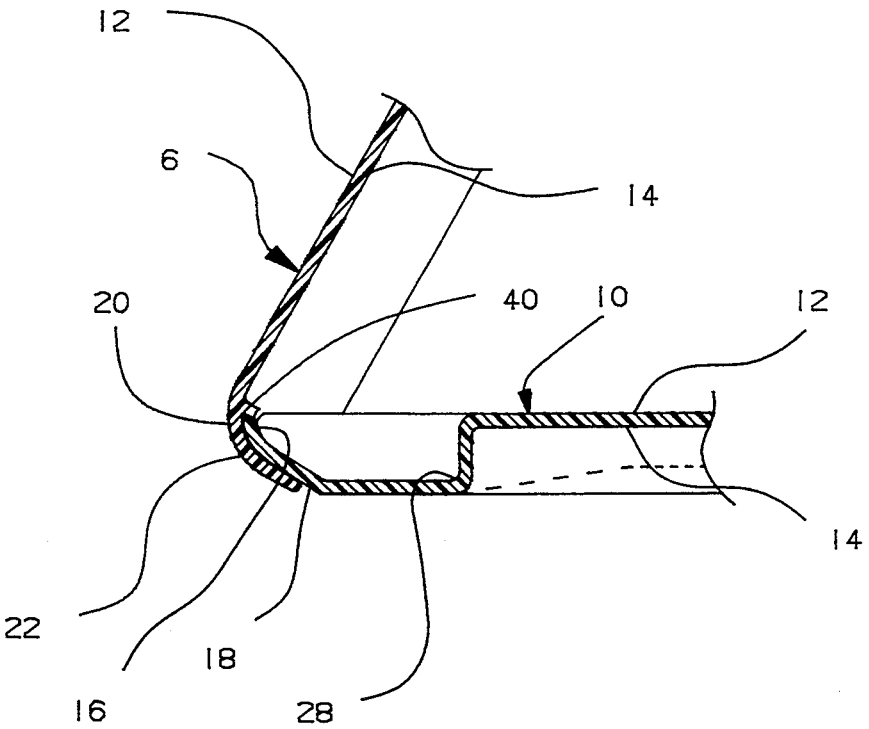
FIG. 4 is an enlarged partial cross-sectional view illustrating the interlocking mechanism of the front panel and the base panel of the portable folding pillow prop apparatus.

Referring to FIG. 4, there is shown a partial cross-sectional view of the front and the base panels 6 and 10 of the pillow prop apparatus 2 attached to each other. This figure shows the transverse top wall 18 of the transverse step-down section 28 engaged with the transverse bottom wall 22 of the front panel 6 such that the pillow prop apparatus 2 is in its upright or open condition. A transverse elongated interior shelf or ledge 40 is located on the lower side 14 and adjacent to the bottom end 20 of the front panel 6 for preventing the transverse top wall 18 of the base panel 10 from moving in a longitudinal direction; therefore the transverse top wall 18 and the transverse bottom wall 22 of the base and front panels respectively are secured together and the pillow prop apparatus 2 will be in its unfolded position.

Referring to FIGS. 1, 2, 3 and 5, there is shown a multiplicity of rib openings 42 on each panel of the pillow prop apparatus 2. The multiplicity of rib openings 42 extend downwardly toward the lower sides 14 of each panel, where the multiplicity of rib openings 42 are located alternatively to each other. The multiplicity of rib openings 42 on the front panel 6 are generally star shaped, and on the rear and base panels 8 and 10 are generally hexagon shaped. The openings 42 reduce the manufacturing costs and the cycle time for the plastic material to cool. It will be appreciated that these star and hexagon openings are not limited to these shapes, as illustrated in FIGS. 1, 2 and 3. It is emphasized that while these shapes are preferred, it is also within the spirit and scope of the present invention to have any multiplicity or types of shaped openings.

Figure 5:
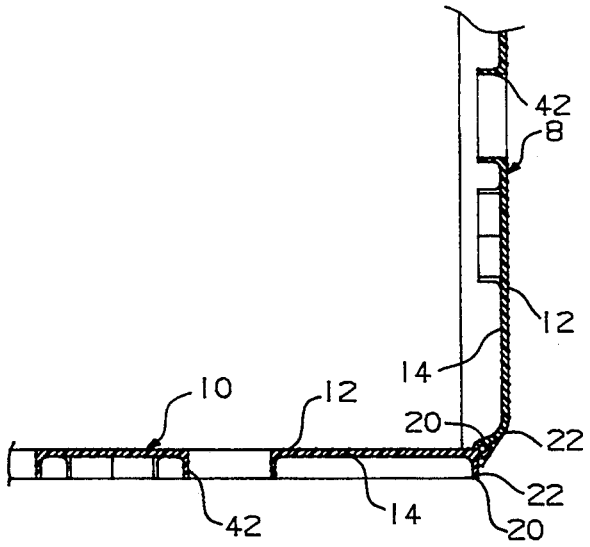
FIG. 5 is an enlarged partial cross-sectional view showing the rear panel hingeably attached to the base panel of the portable folding pillow prop apparatus.

Referring to FIG. 5, there is shown a partial cross-sectional view of the rear and base panels 8 and 10 of the present invention. The bottom end 20 of the rear panel 8 is hingeably attached to the bottom end 20 of the base panel 10, such that the upper side 12 of the base panel 10 is adjacent and in parallel to the lower side 14 of the rear panel 8 when the pillow prop apparatus 2 is in its folded condition.

Figure 6:
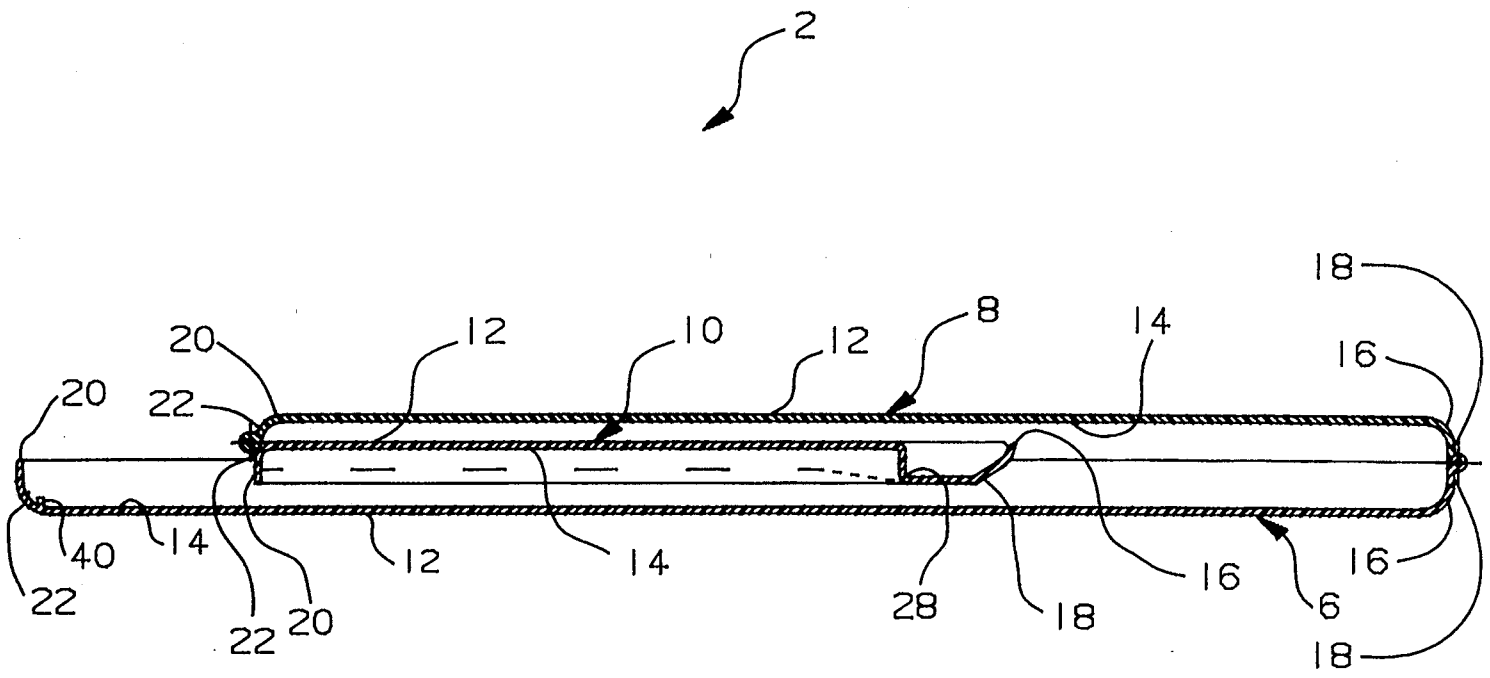
FIG. 6 is a cross-sectional view taken along line 6—6 of FIG. 3.

Referring to FIG. 6, there is shown a cross-sectional view of the pillow prop apparatus 2 in its folded condition. The top end 16 of the front panel 6 is hingeably attached to the top end 16 of the rear panel 8, such that the lower sides 14 of the front and rear panels 6 and 8 are adjacent and toward each other when the pillow prop apparatus 2 is in its folded condition.

Referring to FIGS. 1 through 7, the pillow prop apparatus 2 can be made from several materials. The manufacturing process which could accommodate the construction of the pillow prop apparatus 2 can be injection, thermoform, etc. or other molding process. By way of example, the pillow prop apparatus 2 can be made of styrene material or stiff plastic material.

In general, the uniqueness of the present invention is that it is portable and the three-panel structure can be folded. When folded, the pillow prop apparatus 2 is of the shape and size of a briefcase and can be easily carried around or stored in luggage. When the pillow prop apparatus 2 is unfolded, the three-panel structure forms a body-contacting area that is approximately 30° on one surface and 60° on another surface. These angles have been predetermined to provide the optimum positions for providing back and head support or patient positioning.

The operation of the foregoing embodiment now will be described. When the pillow prop apparatus 2 is to be used, the foldable elongated body 4 can be unfolded by sliding the top end 16 of the base panel 10 away from the top ends 16 of the front and rear panels 6 and 8, thereby interlocking the transverse top wall 18 of the base panel 10 to the transverse bottom wall 22 of the front panel 6. When the pillow prop apparatus 2 is not in use, the foldable elongated body 4 can be folded by lifting the top end 16 of the base panel 10 over the transverse interior shelf 40 of the front panel 6 and sliding the top end 16 towards the top ends 16 of the front and rear panels 6 and 8.

The pillow prop apparatus 2 is maintained in its folded condition by the two opposite interior sidewalls 44 and 46, and the two longitudinal parallel and opposite exterior sidewalls 24 and 26 of the base panel 10. Another means for retaining the pillow prop apparatus 2 is to have a tether member which can be wrapped around the three-panel structures of the pillow prop apparatus 2.

The present invention has many advantageous features including: (a) the pillow prop apparatus is portable; (b) it is inexpensive to manufacture; and (c) it is small and flat to be conveniently stored in narrow areas such as under a bed or in luggage.

Defined in detail, the present invention is a pillow prop apparatus for providing back and head support, comprising: (a) a longitudinal elongated foldable body having a front panel, a rear panel, and a base panel, each panel having an upper side, a lower side, a top end with a transverse top wall, a bottom end with a transverse bottom wall, and two longitudinal opposite exterior sidewalls, the front and rear panels having tapered top ends such that the bottom ends are wider than the top ends, where the top, the bottom, and the two opposite exterior sidewalls of each panel surrounding the lower side; (b) said base panel further having a transverse step-down section located adjacent to said top end such that said transverse top wall is curved inwardly towards said upper side for engaging with said transverse bottom wall of said front panel, and the transverse step-down section having two opposite interior sidewalls located adjacent and parallel to said two longitudinal opposite exterior sidewalls of said base panel; (c) two opposite tabs protruding outwardly from said two opposite interior sidewalls of said base panel and located adjacent to said top end of said base panel; (d) two longitudinal opposite interior sidewalls located on said lower side of said front panel and adjacent to said two longitudinal opposite exterior sidewalls of said front panel, each having a longitudinal guide rail which engages with a respective one of said two opposite tabs for allowing said base panel to slide back and forth from a folded condition to an unfolded condition; (e) a transverse elongated interior shelf located on said lower side and adjacent to said bottom end of said front panel for preventing said transverse top wall of said base panel from moving in a longitudinal direction; (f) means for hingeably attaching said top end of said front panel to said top end of said rear panel, such that said lower sides of said front and rear panels are adjacent and facing each other when said pillow prop apparatus is in its folded condition, and for permitting pivotal movement between said front and rear panels; (g) means for hingeably attaching said bottom end of said rear panel to said bottom end of said base panel, such that said upper side of said base panel is adjacent and in parallel to said lower side of said rear panel when said pillow prop apparatus is in its folded condition, and for permitting pivotal movement between said rear and base panels; (h) said panels of said elongated foldable body each having a multiplicity of rib openings therethrough which extend downwardly toward said lower sides, where the multiplicity of rib openings are located alternatively to each other for providing stability; (i) said front and rear panels each having a rectangular shaped opening therethrough and located adjacent to said top ends of said front and rear panels respectively, where the rectangular shaped openings are aligned to each other once said pillow prop apparatus is in its folded condition for carrying said pillow prop apparatus; and (j) said rear panel having a length less than a length of said front panel but greater than a length of said base panel; (k) whereby when said pillow prop apparatus is to be used, said foldable elongated body can be unfolded by sliding said top end of said base panel away from said top ends of said front and rear panels, thereby interlocking said transverse top wall of said base panel to said transverse bottom wall of said front panel, when said pillow prop apparatus is not in use, said foldable elongated body can be folded by lifting said top end of said base panel over said transverse interior shelf of said front panel and sliding said top end towards said top ends of said front and rear panels.

Defined broadly, the present invention is a pillow prop apparatus for providing back and head support, comprising: (a) a foldable body having a front panel, a rear panel, and a base panel, each panel having an upper side, a lower side, a first end with a top wall, a second end with a bottom wall, and two opposite exterior sidewalls; (b) said base panel further having a step down-section located adjacent to said first end such that said top wall is curved inwardly for engaging with said bottom wall of said front panel, and the step down-section having two opposite interior sidewalls; (c) means for sliding said base panel back and forth within said front panel; (d) an elongated interior shelf located on said lower side adjacent to said second end of said front panel for preventing said first end of said base panel from moving in a longitudinal direction; (e) means for hingeably attaching said first end of said front panel to said first end of said rear panel, such that said lower sides of said front and rear panels are adjacent and facing toward each other when said pillow prop apparatus is in its folded condition, and for permitting pivotal movement between said front and rear panels; (f) means for hingeably attaching said second end of said rear panel to said second end of said base panel, such that said upper side of said base panel is adjacent and in parallel to said lower side of said rear panel when said pillow prop apparatus is in its folded condition, and for permitting pivotal movement between said rear and base panels; (g) said panels of said foldable body each having a multiplicity of openings therethrough, where each opening has raised ridges for providing stability; (h) said front and rear panels each having an opening therethrough and located adjacent to said first ends of said front and rear panels respectively, where the openings are aligned to each other when said pillow prop apparatus is in its folded condition for carrying said pillow prop apparatus; and (i) said rear panel having a length less than a length of said front panel but greater than a length of said base panel; (j) whereby when said pillow prop apparatus is to be used, said foldable body can be unfolded by sliding said first end of said base panel away from said first ends of said front and rear panels, thereby interlocking said top wall of said base panel to said bottom wall of said front panel, when said pillow prop apparatus is not in use, said foldable body can be folded by lifting said first end of said base panel over said elongated interior shelf of said front panel and sliding said first end towards said first ends of said front and rear panels.

Defined more broadly, the present invention is a pillow prop for providing back and head support, comprising: (a) a foldable member having a front section, a rear section and a base section, each section having an upper side, a lower side, a first end, a second end, and two sides; (b) said base section further having a step-down section such that said first end is curved inwardly for engaging with said second end of said front section; (c) means for sliding back and forth said base section within said front section; (d) means for hingeably attaching said front section to said rear section and said rear section to said base section for permitting pivotal movement; and (e) said rear section having a length less than a length of said front section but greater than a length of said base section; (f) whereby when said pillow prop is to be used, said foldable member can be unfolded by sliding said first end of said base section away from said first ends of said front and rear sections, when said pillow prop is not in use, said foldable member can be folded by sliding said first end of said base section towards said first ends of said front and rear sections.

Defined even more broadly, the present invention is a pillow prop for providing back and head support, comprising: (a) a foldable member having a front section, a rear section and a base section, each section having an upper side, a lower side, a first end, a second end, and two lateral edges; (b) means for hingeably attaching said first end of said front section to said first end of said rear section to permit pivotal movement of said front and rear sections; (c) means for hingeably attaching said second end of said base section to said second end of said rear section to permit pivotal movement of said base and said rear sections; and (d) means for slidably retaining said first end of said base section to said lower side of said front section to permit said first end of said base section to slide toward said second end of said front section to unfold said foldable member and also to slide toward said first end of said front section to fold said foldable member; (e) whereby when said pillow prop is to be used, said foldable member can be unfolded by sliding said first end of said base section away from said first ends of said front and rear sections, and when said pillow prop is not in use, said foldable member can be folded by sliding said first end of said base section towards said first ends of said front and rear sections.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A pillow prop apparatus for providing back and head support, comprising:

a. a longitudinal elongated foldable body having a front panel, a rear panel, and a base panel, each panel having an upper side, a lower side, a top end with a transverse top wall, a bottom end with a transverse bottom wall, and two longitudinal opposite exterior sidewalls, the front and rear panels having tapered top ends such that the bottom ends are wider than the top ends, where the top, the bottom, and the two opposite exterior sidewalls of each panel surrounding the lower side;

b. said base panel further having a transverse step-down section located adjacent to said top end such that said transverse top wall is curved inwardly towards said upper side for engaging with said transverse bottom wall of said front panel, and the transverse step-down section having two opposite interior sidewalls located adjacent and parallel to said two longitudinal opposite exterior sidewalls of said base panel;

c. two opposite tabs protruding outwardly from said two opposite interior sidewalls of said base panel and located adjacent to said top end of said base panel;

d. two longitudinal opposite interior sidewalls located on said lower side of said front panel and adjacent to said two longitudinal opposite exterior sidewalls of said front panel, each having a longitudinal guide rail which engages with a respective one of said two opposite tabs for allowing said base panel to slide back and forth from a folded condition to an unfolded condition;

e. a transverse elongated interior shelf located on said lower side and adjacent to said bottom end of said front panel for preventing said transverse top wall of said base panel from moving in a longitudinal direction;

f. means for hingeably attaching said top end of said front panel to said top end of said rear panel, such that said lower sides of said front and rear panels are adjacent and facing each other when said pillow prop apparatus is in its folded condition, and for permitting pivotal movement between said front and rear panels;

g. means for hingeably attaching said bottom end of said rear panel to said bottom end of said base panel, such that said upper side of said base panel is adjacent and in parallel to said lower side of said rear panel when said pillow prop apparatus is in its folded condition, and for permitting pivotal movement between said rear and base panels;

h. said panels of said elongated foldable body each having a multiplicity of rib openings therethrough which extend downwardly toward said lower sides, where the multiplicity of rib openings are located alternatively to each other for providing stability;

i. said front and rear panels each having a rectangular shaped opening therethrough and located adjacent to said top ends of said front and rear panels respectively, where the rectangular shaped openings are aligned to each other once said pillow prop apparatus is in its folded condition for carrying said pillow prop apparatus; and j. said rear panel having a length less than a length of said front panel but greater than a length of said base panel;

k. whereby when said pillow prop apparatus is to be used, said foldable elongated body can be unfolded by sliding said top end of said base panel away from said top ends of said front and rear panels, thereby interlocking said transverse top wall of said base panel to said transverse bottom wall of said front panel, when said pillow prop apparatus is not in use, said foldable elongated body can be folded by lifting said top end of said base panel over said transverse interior shelf of said front panel and sliding said top end towards said top ends of said front and rear panels.

2. The invention as defined in claim 1 further comprising a rectangular shaped detent recess located on said upper side of said front panel and adjacent to said bottom end for providing an identification.

3. The invention as defined in claim 1 wherein said pillow prop apparatus can be used in two positions, a 30° position and a 60° position.

4. The invention as defined in claim 1 wherein said pillow prop apparatus is made out of styrene material.

5. The invention as defined in claim 1 wherein said multiplicity of rib openings are generally star shape.

6. The invention as defined in claim 1 wherein said multiplicity of rib openings are generally hexagon shape.

7. The invention as defined in claim 1 wherein said pillow prop apparatus is portable.

8. A pillow prop apparatus for providing back and head support, comprising:

a. a foldable body having a front panel, a rear panel, and a base panel, each panel having an upper side, a lower side, a first end with a top wall, a second end with a bottom wall, and two opposite exterior sidewalls;

b. said base panel further having a step down-section located adjacent to said first end such that said top wall is curved inwardly for engaging with said bottom wall of said front panel, and the step down-section having two opposite interior sidewalls;

c. means for sliding said base panel back and forth within said front panel;

d. an elongated interior shelf located on said lower side adjacent to said second end of said front panel for preventing said first end of said base panel from moving in a longitudinal direction;

e. means for hingeably attaching said first end of said front panel to said first end of said rear panel, such that said lower sides of said front and rear panels are adjacent and facing toward each other when said pillow prop apparatus is in its folded condition, and for permitting pivotal movement between said front and rear panels;

f. means for hingeably attaching said second end of said rear panel to said second end of said base panel, such that said upper side of said base panel is adjacent and in parallel to said lower side of said rear panel when said pillow prop apparatus is in its folded condition, and for permitting pivotal movement between said rear and base panels;

g. said panels of said foldable body each having a multiplicity of openings therethrough, where each opening has raised ridges for providing stability;

h. said front and rear panels each having an opening therethrough and located adjacent to said first ends of said front and rear panels respectively, where the openings are aligned to each other when said pillow prop apparatus is in its folded condition for carrying said pillow prop apparatus; and i. said rear panel having a length less than a length of said front panel but greater than a length of said base panel;

j. whereby when said pillow prop apparatus is to be used, said foldable body can be unfolded by sliding said first end of said base panel away from said first ends of said front and rear panels, thereby interlocking said top wall of said base panel to said bottom wall of said front panel, when said pillow prop apparatus is not in use, said foldable body can be folded by lifting said first end of said base panel over said elongated interior shelf of said front panel and sliding said first end towards said first ends of said front and rear panels.

9. The invention as defined in claim 8 further comprising a detent recess located on said upper side of said front panel and adjacent to said second end for providing an identification.

10. The invention as defined in claim 8 wherein said pillow prop apparatus can be used in two positions, a 30° position and a 60° position.

11. The invention as defined in claim 8 wherein said pillow prop apparatus is made out of styrene material.

12. The invention as defined in claim 8 wherein said multiplicity of openings are generally star shape.

13. The invention as defined in claim 8 wherein said multiplicity of openings are generally hexagon shape.

14. The invention as defined in claim 8 wherein said means for sliding back and forth said base panel within said front panel includes two opposite tabs protruding outwardly on said two opposite interior sidewalls of said base panel respectively and located adjacent to said first end of said base panel, and two opposite interior sidewalls located on said lower side of said front panel adjacent and between said two opposite exterior sidewalls respectively, each having a guide rail which engages with a respective one of the two opposite tabs.

15. The invention as defined in claim 8 wherein said front and rear panels are tapered at said first ends such that said second ends are wider than said first ends.

16. The invention as defined in claim 8 wherein said pillow prop apparatus is portable.

17. A pillow prop for providing back and head support, comprising:

a. a foldable member having a front section, a rear section and a base section, each section having an upper side, a lower side, a first end, a second end, and two sides;

b. said base section further having a step-down section such that said first end is curved inwardly for engaging with said second end of said front section;

c. means for sliding back and forth said base section within said front section;

d. means for hingeably attaching said front section to said rear section and said rear section to said base section for permitting pivotal movement; and e. said rear section having a length less than a length of said front section but greater than a length of said base section;

f. whereby when said pillow prop is to be used, said foldable member can be unfolded by sliding said first end of said base section away from said first ends of said front and rear sections, when said pillow prop is not in use, said foldable member can be folded by sliding said first end of said base section towards said first ends of said front and rear sections.

18. The invention as defined in claim 17 further comprising a multiplicity of openings on each said section of said foldable member, where each opening has raised ridges.

19. The invention as defined in claim 17 wherein said multiplicity of openings are generally star shape.

20. The invention as defined in claim 17 wherein said multiplicity of openings are generally hexagon shape.

21. The invention as defined in claim 17 wherein said pillow prop is portable.

22. The invention as defined in claim 17 wherein said foldable member of said pillow prop is made of stiff plastic material.

23. The invention as defined in claim 17 wherein said front and rear sections each having an opening therethrough, where the openings are aligned to each other when said foldable member is in its folded condition for carrying said pillow prop.

24. The invention as defined in claim 17 wherein said means for sliding back and forth said base section within said front section includes two fasteners protruding outwardly from two interior sides of said base section and located adjacent to said step-down section of said base section, and two opposite interior sides located on said lower side of said front section adjacent and between said two sides of said front section respectively, each having a guide rail which engages with a respective one of the two fasteners.

25. A pillow prop for providing back and head support, comprising:

a. a foldable member having a front section, a rear section and a base section, each section having an upper side, a lower side, a first end, a second end, and two lateral edges;

b. means for hingeably attaching said first end of said front section to said first end of said rear section to permit pivotal movement of said front and rear sections;

c. means for hingeably attaching said second end of said rear section to said second end of said base section to permit pivotal movement of said base and said rear sections; and d. means for slidably retaining said first end of said base section to said lower side of said front section to permit said first end of said base section to slide toward said second end of said front section to unfold said foldable member and also to slide toward said first end of said front section to fold said foldable member;

e. whereby when said pillow prop is to be used, said foldable member can be unfolded by sliding said first end of said base section away from said first ends of said front and rear sections, and when said pillow prop is not in use, said foldable member can be folded by sliding said first end of said base section towards said first ends of said front and rear sections.

26. The invention as defined in claim 25 wherein said pillow prop is portable.

27. The invention as defined in claim 25 wherein said foldable member of said pillow prop is made of plastic material.

28. The invention as defined in claim 25 wherein said front and rear sections each having an opening therethrough, where the openings are aligned to each other when said foldable member is in its folded condition for carrying said pillow prop.

29. The invention as defined in claim 25 wherein said means for sliding back and forth said base section within said front section includes two fasteners protruding outwardly from two opposite interior sides of said base section and located adjacent to said first end and parallel to said two sides of said base section, and two opposite interior sides located on said lower surface of said front section adjacent and between said two sides of said front section respectively, each having a guide rail which engages with a respective one of the two fasteners.

* * * * *